US006217147B1

(12) United States Patent
Holstun

(10) Patent No.: US 6,217,147 B1
(45) Date of Patent: Apr. 17, 2001

(54) PRINTER HAVING MEDIA ADVANCE COORDINATED WITH PRIMITIVE SIZE

(75) Inventor: Clayton L. Holstun, San Marcos, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/227,500

(22) Filed: Jan. 7, 1999

(51) Int. Cl.[7] ..... B41J 2/145; B41J 2/15; B41J 29/38

(52) U.S. Cl. ..... 347/40; 347/16

(58) Field of Search ..... 347/9, 14, 40, 347/104, 105, 16

(56) References Cited

U.S. PATENT DOCUMENTS

| | | | |
|---|---|---|---|
| 4,965,593 | 10/1990 | Hickman | 347/12 |
| 5,276,467 | 1/1994 | Meyer et al. | 347/19 |
| 5,376,958 | 12/1994 | Richtsmeier et al. | 347/40 |
| 5,555,006 | 9/1996 | Cleveland et al. | 347/41 |
| 5,638,101 | 6/1997 | Keefe et al. | 347/65 |
| 5,675,365 * | 10/1997 | Becerra et al. | 347/9 |
| 5,684,517 * | 11/1997 | Clement et al. | 347/43 |
| 5,929,876 * | 7/1999 | Bartolome | 347/20 |

* cited by examiner

*Primary Examiner*—Thinh Nguyen

(57) ABSTRACT

A printer, which reduces dot displacement error and horizontal banding, includes a scanning carriage, a printhead mounted on the scanning carriage, and an advance mechanism. The printhead includes a plurality of primitives, each primitive having a plurality of non-staggered nozzles and associated ink ejection elements. Each primitive has a primitive size defined by the number of nozzles in the primitive. The printer further includes an address select circuit, electrically coupled to the ink ejection elements and having a plurality of address lines. The ink ejection elements are arranged such that elements of different primitives located at the same position on their respective primitives have the same address line. The advance mechanism advances a medium through the printer by a distance equal to an even multiple of, for example, twice, the primitive size, so that each row of ink is generated by ink ejection elements of the same address line. Other multiples may also be used.

23 Claims, 21 Drawing Sheets

| NOZZLE | PRIM # | ADDR # | NOZZLE | PRIM # | ADDR # |
|---|---|---|---|---|---|
| 1 | 1 | 1 | 51 | 5 | 4 |
| 2 | 2 | 1 | 52 | 6 | 4 |
| 3 | 1 | 2 | 53 | 5 | 5 |
| 4 | 2 | 2 | 54 | 6 | 5 |
| 5 | 1 | 3 | 55 | 5 | 6 |
| 6 | 2 | 3 | 56 | 6 | 6 |
| 7 | 1 | 4 | 57 | 5 | 7 |
| 8 | 2 | 4 | 58 | 6 | 7 |
| 9 | 1 | 5 | 59 | 5 | 8 |
| 10 | 2 | 5 | 60 | 6 | 8 |
| 11 | 1 | 6 | 61 | 5 | 9 |
| 12 | 2 | 6 | 62 | 6 | 9 |
| 13 | 1 | 7 | 63 | 5 | 10 |
| 14 | 2 | 7 | 64 | 6 | 10 |
| 15 | 1 | 8 | 65 | 5 | 11 |
| 16 | 2 | 8 | 66 | 6 | 11 |
| 17 | 1 | 9 | 67 | 7 | 1 |
| 18 | 2 | 9 | 68 | 8 | 1 |
| 19 | 1 | 10 | 69 | 7 | 2 |
| 20 | 2 | 10 | 70 | 8 | 2 |
| 21 | 1 | 11 | 71 | 7 | 3 |
| 22 | 2 | 11 | 72 | 8 | 3 |
| 23 | 3 | 1 | 73 | 7 | 4 |
| 24 | 4 | 1 | 74 | 8 | 4 |
| 25 | 3 | 2 | 75 | 7 | 5 |
| 26 | 4 | 2 | 76 | 8 | 5 |
| 27 | 3 | 3 | 77 | 7 | 6 |
| 28 | 4 | 3 | 78 | 8 | 6 |
| 29 | 3 | 4 | 79 | 7 | 7 |
| 30 | 4 | 4 | 80 | 8 | 7 |
| 31 | 3 | 5 | 81 | 7 | 8 |
| 32 | 4 | 5 | 82 | 8 | 8 |
| 33 | 3 | 6 | 83 | 7 | 9 |
| 34 | 4 | 6 | 84 | 8 | 9 |
| 35 | 3 | 7 | 85 | 7 | 10 |
| 36 | 4 | 7 | 86 | 8 | 10 |
| 37 | 3 | 8 | 87 | 7 | 11 |
| 38 | 4 | 8 | 88 | 8 | 11 |
| 39 | 3 | 9 | 89 | 9 | 1 |
| 40 | 4 | 9 | 90 | 10 | 1 |
| 41 | 3 | 10 | 91 | 9 | 2 |
| 42 | 4 | 10 | 92 | 10 | 2 |
| 43 | 3 | 11 | 93 | 9 | 3 |
| 44 | 4 | 11 | 94 | 10 | 4 |
| 45 | 5 | 1 | 95 | 9 | 4 |
| 46 | 6 | 1 | 96 | 10 | 4 |
| 47 | 5 | 2 | 97 | 9 | 5 |
| 48 | 6 | 2 | 98 | 10 | 5 |
| 49 | 5 | 3 | 99 | 9 | 6 |
| 50 | 6 | 3 | 100 | 10 | 6 |

| NOZZLE | PRIM # | ADDR # | | NOZZLE | PRIM # | ADDR # |
|---|---|---|---|---|---|---|
| 1 | 1 | 1 | | 51 | 5 | 4 |
| 2 | 2 | 1 | | 52 | 6 | 4 |
| 3 | 1 | 2 | | 53 | 5 | 5 |
| 4 | 2 | 2 | | 54 | 6 | 5 |
| 5 | 1 | 3 | | 55 | 5 | 6 |
| 6 | 2 | 3 | | 56 | 6 | 6 |
| 7 | 1 | 4 | | 57 | 5 | 7 |
| 8 | 2 | 4 | | 58 | 6 | 7 |
| 9 | 1 | 5 | | 59 | 5 | 8 |
| 10 | 2 | 5 | | 60 | 6 | 8 |
| 11 | 1 | 6 | | 61 | 5 | 9 |
| 12 | 2 | 6 | | 62 | 6 | 9 |
| 13 | 1 | 7 | | 63 | 5 | 10 |
| 14 | 2 | 7 | | 64 | 6 | 10 |
| 15 | 1 | 8 | | 65 | 5 | 11 |
| 16 | 2 | 8 | | 66 | 6 | 11 |
| 17 | 1 | 9 | | 67 | 7 | 1 |
| 18 | 2 | 9 | | 68 | 8 | 1 |
| 19 | 1 | 10 | | 69 | 7 | 2 |
| 20 | 2 | 10 | | 70 | 8 | 2 |
| 21 | 1 | 11 | | 71 | 7 | 3 |
| 22 | 2 | 11 | | 72 | 8 | 3 |
| 23 | 3 | 1 | | 73 | 7 | 4 |
| 24 | 4 | 1 | | 74 | 8 | 4 |
| 25 | 3 | 2 | | 75 | 7 | 5 |
| 26 | 4 | 2 | | 76 | 8 | 5 |
| 27 | 3 | 3 | | 77 | 7 | 6 |
| 28 | 4 | 3 | | 78 | 8 | 6 |
| 29 | 3 | 4 | | 79 | 7 | 7 |
| 30 | 4 | 4 | | 80 | 8 | 7 |
| 31 | 3 | 5 | | 81 | 7 | 8 |
| 32 | 4 | 5 | | 82 | 8 | 8 |
| 33 | 3 | 6 | | 83 | 7 | 9 |
| 34 | 4 | 6 | | 84 | 8 | 9 |
| 35 | 3 | 7 | | 85 | 7 | 10 |
| 36 | 4 | 7 | | 86 | 8 | 10 |
| 37 | 3 | 8 | | 87 | 7 | 11 |
| 38 | 4 | 8 | | 88 | 8 | 11 |
| 39 | 3 | 9 | | 89 | 9 | 1 |
| 40 | 4 | 9 | | 90 | 10 | 1 |
| 41 | 3 | 10 | | 91 | 9 | 2 |
| 42 | 4 | 10 | | 92 | 10 | 2 |
| 43 | 3 | 11 | | 93 | 9 | 3 |
| 44 | 4 | 11 | | 94 | 10 | 4 |
| 45 | 5 | 1 | | 95 | 9 | 4 |
| 46 | 6 | 1 | | 96 | 10 | 4 |
| 47 | 5 | 2 | | 97 | 9 | 5 |
| 48 | 6 | 2 | | 98 | 10 | 5 |
| 49 | 5 | 3 | | 99 | 9 | 6 |
| 50 | 6 | 3 | | 100 | 10 | 6 |

FIG. 11A

| NOZZLE | PRIM # | ADDR # | | NOZZLE | PRIM # | ADDR # |
|---|---|---|---|---|---|---|
| 101 | 9 | 7 | | 151 | 13 | 10 |
| 102 | 10 | 7 | | 152 | 14 | 10 |
| 103 | 9 | 8 | | 153 | 13 | 11 |
| 104 | 10 | 8 | | 154 | 14 | 11 |
| 105 | 9 | 9 | | 155 | 15 | 1 |
| 106 | 10 | 9 | | 156 | 16 | 1 |
| 107 | 9 | 10 | | 157 | 15 | 2 |
| 108 | 10 | 10 | | 158 | 16 | 2 |
| 109 | 9 | 11 | | 159 | 15 | 3 |
| 110 | 10 | 11 | | 160 | 16 | 3 |
| 111 | 11 | 1 | | 161 | 15 | 4 |
| 112 | 12 | 1 | | 162 | 16 | 4 |
| 113 | 11 | 2 | | 163 | 15 | 5 |
| 114 | 12 | 2 | | 164 | 16 | 5 |
| 115 | 11 | 3 | | 165 | 15 | 6 |
| 116 | 12 | 3 | | 166 | 16 | 6 |
| 117 | 11 | 4 | | 167 | 15 | 7 |
| 118 | 12 | 4 | | 168 | 16 | 7 |
| 119 | 11 | 5 | | 169 | 15 | 8 |
| 120 | 12 | 5 | | 170 | 16 | 8 |
| 121 | 11 | 6 | | 171 | 15 | 9 |
| 122 | 12 | 6 | | 172 | 16 | 9 |
| 123 | 11 | 7 | | 173 | 15 | 10 |
| 124 | 12 | 7 | | 174 | 16 | 10 |
| 125 | 11 | 8 | | 175 | 15 | 11 |
| 126 | 12 | 8 | | 176 | 16 | 11 |
| 127 | 11 | 9 | | 177 | 17 | 1 |
| 128 | 12 | 9 | | 178 | 18 | 1 |
| 129 | 11 | 10 | | 179 | 17 | 2 |
| 130 | 12 | 10 | | 180 | 18 | 2 |
| 131 | 11 | 11 | | 181 | 17 | 3 |
| 132 | 12 | 11 | | 182 | 18 | 3 |
| 133 | 13 | 1 | | 183 | 17 | 4 |
| 134 | 14 | 1 | | 184 | 18 | 4 |
| 135 | 13 | 2 | | 185 | 17 | 5 |
| 136 | 14 | 2 | | 186 | 18 | 5 |
| 137 | 13 | 3 | | 187 | 17 | 6 |
| 138 | 14 | 3 | | 188 | 18 | 6 |
| 139 | 13 | 4 | | 189 | 17 | 7 |
| 140 | 14 | 4 | | 190 | 18 | 7 |
| 141 | 13 | 5 | | 191 | 17 | 8 |
| 142 | 14 | 5 | | 192 | 18 | 8 |
| 143 | 13 | 6 | | 193 | 17 | 9 |
| 144 | 14 | 6 | | 194 | 18 | 9 |
| 145 | 13 | 7 | | 195 | 17 | 10 |
| 146 | 14 | 7 | | 196 | 18 | 10 |
| 147 | 13 | 8 | | 197 | 17 | 11 |
| 148 | 14 | 8 | | 198 | 18 | 11 |
| 149 | 13 | 9 | | 199 | 19 | 1 |
| 150 | 14 | 9 | | 200 | 20 | 1 |

FIG. 11B

| NOZZLE | PRIM # | ADDR # | | NOZZLE | PRIM # | ADDR # |
|---|---|---|---|---|---|---|
| 201 | 19 | 2 | | 255 | 23 | 7 |
| 202 | 20 | 2 | | 256 | 24 | 7 |
| 203 | 19 | 3 | | 257 | 23 | 8 |
| 204 | 20 | 3 | | 258 | 24 | 8 |
| 205 | 19 | 4 | | 259 | 23 | 9 |
| 206 | 20 | 4 | | 260 | 24 | 9 |
| 207 | 19 | 5 | | 261 | 23 | 10 |
| 208 | 20 | 5 | | 262 | 24 | 10 |
| 209 | 19 | 6 | | 263 | 23 | 11 |
| 210 | 20 | 6 | | 264 | 24 | 11 |
| 211 | 19 | 7 | | 265 | 25 | 1 |
| 212 | 20 | 7 | | 266 | 26 | 1 |
| 213 | 19 | 8 | | 267 | 25 | 2 |
| 214 | 20 | 8 | | 268 | 26 | 2 |
| 215 | 19 | 9 | | 269 | 25 | 3 |
| 216 | 20 | 9 | | 270 | 26 | 3 |
| 217 | 19 | 10 | | 271 | 25 | 4 |
| 218 | 20 | 10 | | 272 | 26 | 4 |
| 219 | 19 | 11 | | 273 | 25 | 5 |
| 220 | 20 | 11 | | 274 | 26 | 5 |
| 221 | 21 | 1 | | 275 | 25 | 6 |
| 222 | 22 | 1 | | 276 | 26 | 6 |
| 223 | 21 | 2 | | 277 | 25 | 7 |
| 224 | 22 | 2 | | 278 | 26 | 7 |
| 225 | 21 | 3 | | 279 | 25 | 8 |
| 226 | 22 | 3 | | 280 | 26 | 8 |
| 227 | 21 | 4 | | 281 | 25 | 9 |
| 228 | 22 | 4 | | 282 | 26 | 9 |
| 229 | 21 | 5 | | 283 | 25 | 10 |
| 230 | 22 | 5 | | 284 | 26 | 10 |
| 231 | 21 | 6 | | 285 | 25 | 11 |
| 232 | 22 | 6 | | 286 | 26 | 11 |
| 233 | 21 | 7 | | 287 | 27 | 1 |
| 234 | 22 | 7 | | 288 | 28 | 1 |
| 235 | 21 | 8 | | 289 | 27 | 2 |
| 236 | 22 | 8 | | 290 | 28 | 2 |
| 237 | 21 | 9 | | 291 | 27 | 3 |
| 238 | 22 | 9 | | 292 | 28 | 3 |
| 239 | 21 | 10 | | 293 | 27 | 4 |
| 240 | 22 | 10 | | 294 | 28 | 4 |
| 241 | 21 | 11 | | 295 | 27 | 5 |
| 242 | 22 | 11 | | 296 | 28 | 5 |
| 243 | 23 | 1 | | 297 | 27 | 6 |
| 244 | 24 | 1 | | 298 | 28 | 6 |
| 245 | 23 | 2 | | 299 | 27 | 7 |
| 246 | 24 | 2 | | 300 | 28 | 7 |
| 247 | 23 | 3 | | 301 | 27 | 8 |
| 248 | 24 | 3 | | 302 | 28 | 8 |
| 249 | 23 | 4 | | 303 | 27 | 9 |
| 250 | 24 | 4 | | 304 | 28 | 9 |
| 251 | 23 | 5 | | 305 | 27 | 10 |
| 252 | 24 | 5 | | 306 | 28 | 10 |
| 253 | 23 | 6 | | 307 | 27 | 11 |
| 254 | 24 | 6 | | 308 | 28 | 11 |

FIG. 11C

PRINTER HAVING MEDIA ADVANCE COORDINATED WITH PRIMITIVE SIZE

FIELD OF THE INVENTION

The present invention relates to inkjet printers. More particularly, the present invention relates to a printer which reduces dot displacement error and horizontal banding.

BACKGROUND

Inkjet printers, including color inkjet printers, are well-known. Inkjet printers incorporate one or more printheads in a scanning carriage. The printheads are typically housed in one or more print cartridges either containing ink or having ink supplied to them from an external source. The ink is channeled to vaporization chambers formed in a substrate associated with each printhead. Within each vaporization chamber is an ink ejection element, such as a resistive heater or a piezoelectric element. A nozzle plate resides over each printhead such that each nozzle is aligned over a respective vaporization chamber. Each printhead may have hundreds of nozzles formed therein for printing 300 or more dots per inch (dpi). As the scanning carriage scans across a printing medium from left to right and back, energization signals are provided to the ink ejection elements and the nozzles eject droplets of ink onto the printing medium to produce a printed image.

Typically, the scanning carriage of an inkjet printer scans across the printing medium several times to complete a swath of ink. Multiple passes of the scanning carriage are preferred to a single pass for several reasons. For example, a defective nozzle or ink ejection element would result in a white horizontal line across the medium. A single pass depositing all the ink needed for the image may provide too much ink in too short of a time to be absorbed by the medium. This would result in excessive ink bleed, excessive drying times, and cockling (warping) of the medium. Also, a single pass may not be sufficient to provide the desired color saturation. For at least these reasons, high quality inkjet printers use multiple passes, when appropriate, such that only a fraction of the total ink required for the image is deposited in a single pass, and any areas not covered by the first pass are filled by one or more later passes. Multiple pass techniques in an inkjet printer have been described in U.S. Pat. Nos. 5,555,006, 5,476,958, 5,276,467 and 4,965,593, which are assigned to the present assignee and incorporated herein by reference.

One problem with conventional inkjet printers is ink droplet or dot displacement. This problem is most apparent when printing a vertical line. Typical print cartridges cycle through their fire order only once per pixel. Since print cartridges continuously proceed through their fire order as the scanning carriage moves across the medium, ink droplets ejected from nozzles at the beginning of the fire order are deposited at their desired location, while those ejected at the end of the fire order are displaced from their desired position by a distance equal to the pixel width. For a 600 dpi printer, this error distance is 42 microns. Thus, a resulting vertical line will appear jagged rather than straight.

One solution to the dot displacement problem is to stagger the physical position of the nozzles and their respective vaporization chambers on the substrate of the printhead. Although effective at solving the dot displacement problem, this approach is relatively complex. The ink flow distance from the edge of the substrate to a vaporization chamber varies depending on the location of the particular vaporization chamber. Vaporization chambers located closer to the edge refill faster than those further away. This creates differences in both the volume and velocity of ejected ink droplets.

Another solution to the dot displacement problem involves rotating the entire substrate. This approach, however, employs a more complex print cartridge and scanning carriage in order to create the rotation. In addition, this print cartridge is more difficult to code and requires additional memory, since data for many different columns must be buffered up simultaneously.

Still another approach is minimizing dot displacement error by increasing the number of times per pixel that a print cartridge with non-staggered nozzles cycles through its fire order. A different problem, however, called horizontal banding exists. Visible horizontal bands result from repetitive variations in row densities due to positional errors in the displacement of ink droplets. Horizontal bands are more apparent among multiple pass printers that do not compensate for dot displacement with staggered nozzles than among those that do.

FIG. 1 illustrates the problem of horizontal banding. Here, a swath of ink has been deposited by a 600 dpi printer in a two-pass printing operation. The print cartridge of this printer, which cycles through its fire order four times per pixel, has non-staggered nozzles and a primitive size of eight. Each of the eight address lines of the print cartridge has a characteristic dot displacement error, which increases from address line 1 to address line 8. In FIG. 1 there is a visible horizontal band in rows 13–16 and 29–32. These bands result from a mismatch between the number of rows which the media is advanced and the primitive size. Because of the mismatch, the odd columns of each row are formed by nozzles associated with address lines different from those which form the even columns. Here, the printer advances the medium by twenty rows, and the primitive size is eight. The odd columns of rows 13 and 14 are printed by nozzles associated with address line 7, while the even columns are printed by nozzles associated with address line 1. Since the dot displacement error differs for the two address lines, with the error of address line 7 being greater than that of address line 1, the spacing between adjacent dots along the row varies, creating a distracting horizontal band.

There is a need, therefore, for a simple, high speed printer that reduces dot displacement error and horizontal banding.

SUMMARY OF THE INVENTION

In accordance with one embodiment of the present invention, a printer for printing rows of ink dots onto a medium is provided. The printer includes a scanning carriage, a printhead and an advance mechanism. The printhead is mounted on the scanning carriage which scans across the medium. The printhead includes a plurality of primitives, each of which has a plurality of non-staggered nozzles for ejecting ink and a plurality of ink ejection elements. Each ink ejection element is associated with a respective nozzle of a respective primitive. Each primitive has a primitive size defined by the number of nozzles in the primitive. The printer further includes an address select circuit electrically coupled to the ink ejection elements of the printhead and having a plurality of address lines. The ink ejection elements of the different primitives are organized such that those elements located at the same position on their respective primitives have the same address line. The advance mechanism advances the medium through the printer by a distance or number of rows equal to an even multiple of the primitive size. This multiple enables ink dots within a row to be generated by ink ejection elements associated with the same address line. As a result, any error associated with fire order timing remains constant for the particular row, thereby reducing horizontal banding.

In accordance with a second embodiment of the invention, a method of printing rows of ink dots onto a medium includes scanning a printhead across the medium to print a first portion of the rows of ink dots, advancing the medium, and scanning the printhead across the medium to print a second portion of the rows of ink dots. The printhead includes a plurality of primitives, nonstaggered nozzles and ink ejection elements, similar to that described with respect to the first embodiment. The medium is advanced by a distance equal to an even multiple of the primitive size of the printhead. This enables ink dots within a row to be printed by ink ejection elements associated with the same address line, thereby reducing horizontal banding.

BRIEF DESCRIPTION OF THE DRAWINGS

The present invention may be better understood, and its numerous objects, features, and advantages made apparent to those skilled in the art by referencing the accompanying drawings.

FIGS. 11A–11C are a table showing the Primitive Select and Address Select lines for each of the 308 ink ejection elements of the TAB head assembly of FIG. 7.

The use of the same reference symbols in different drawings indicates similar or identical items.

DETAILED DESCRIPTION OF THE EMBODIMENTS

Figure 1:
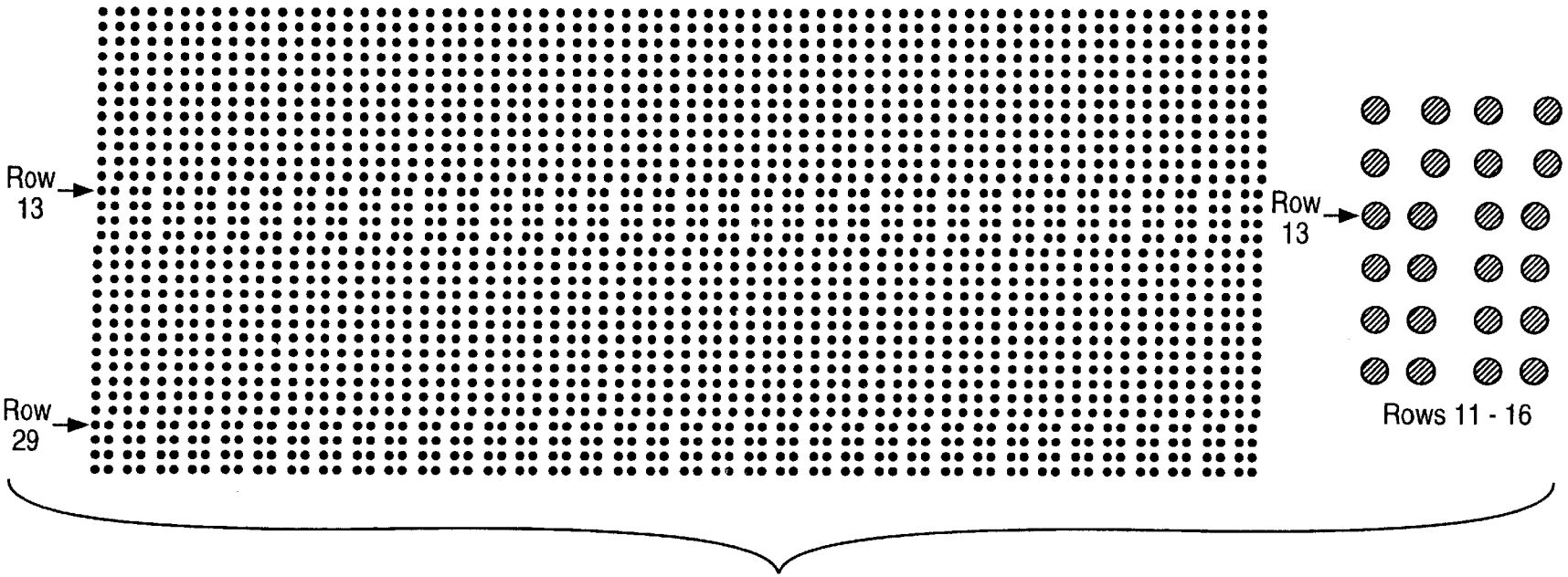
FIG. 1 (PRIOR ART)
FIG. 1 is an example of a swath of ink produced by a printer in which the media advance is not coordinated with the print cartridge primitive size.
Figure 2:
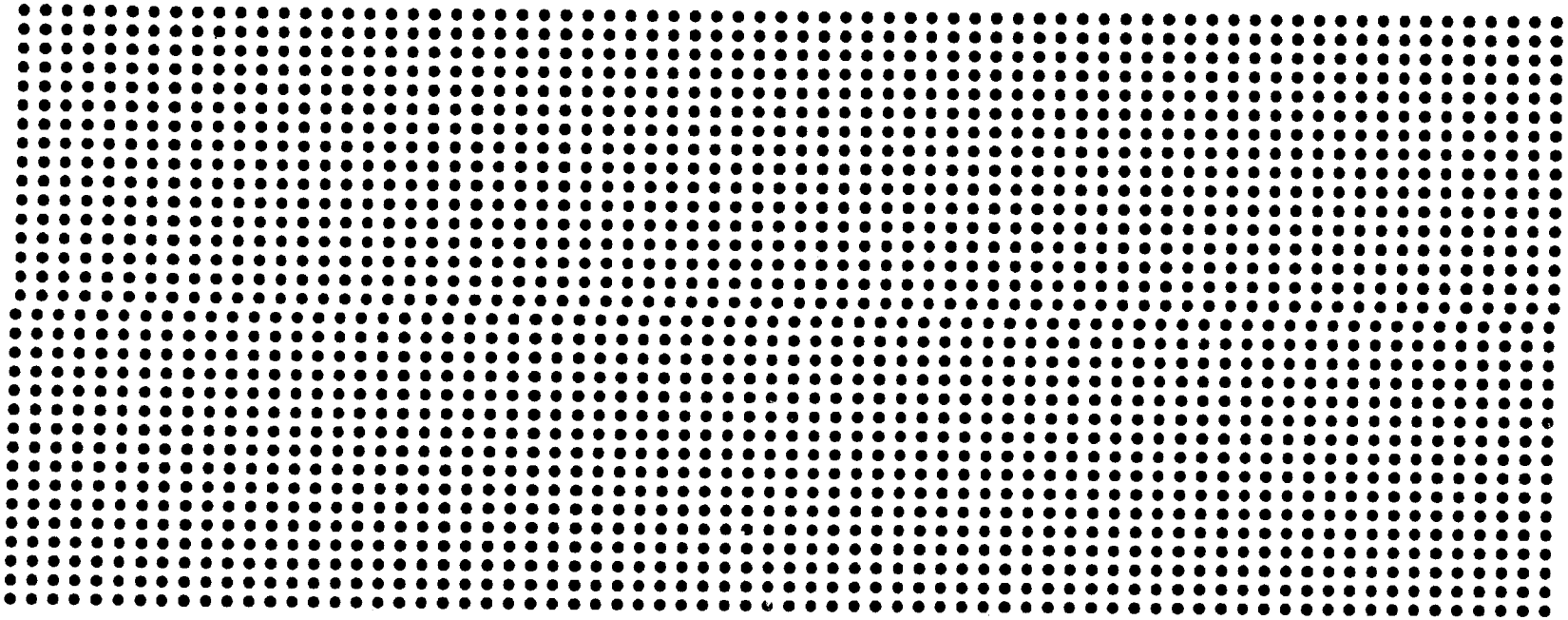
FIG. 2 is an example of a swath of ink produced by a printer in accordance with the present invention, coordinating the media advance with the print cartridge primitive size.

In the present invention, a printer including a print cartridge with non-staggered nozzles has reduced dot displacement error and horizontal banding. The printer minimizes these problems by coordinating the media advance with the print cartridge primitive size. The printer preferably advances the media by a number of rows equal to an even multiple of the primitive size. Thus, each row of dots is generated by nozzles associated with the same address line, thereby maintaining the dot displacement error along the row constant. FIG. 2 illustrates an example of a swath of ink produced by a printer in accordance with the invention. The printer has a print cartridge identical to the one that produced the swath of ink in FIG. 1. This printer, however, advances the medium by sixteen rows, twice the primitive size, as opposed to twenty rows, as shown in FIG. 1. Accordingly, for each row the odd and even columns are generated by nozzles associated with the same address line. The spacing between adjacent dots of a given row remains constant. Only a minor visual disturbance exists between rows 16 and 17. This is the transition point between two adjacent primitives of the print cartridge.

Figure 3:
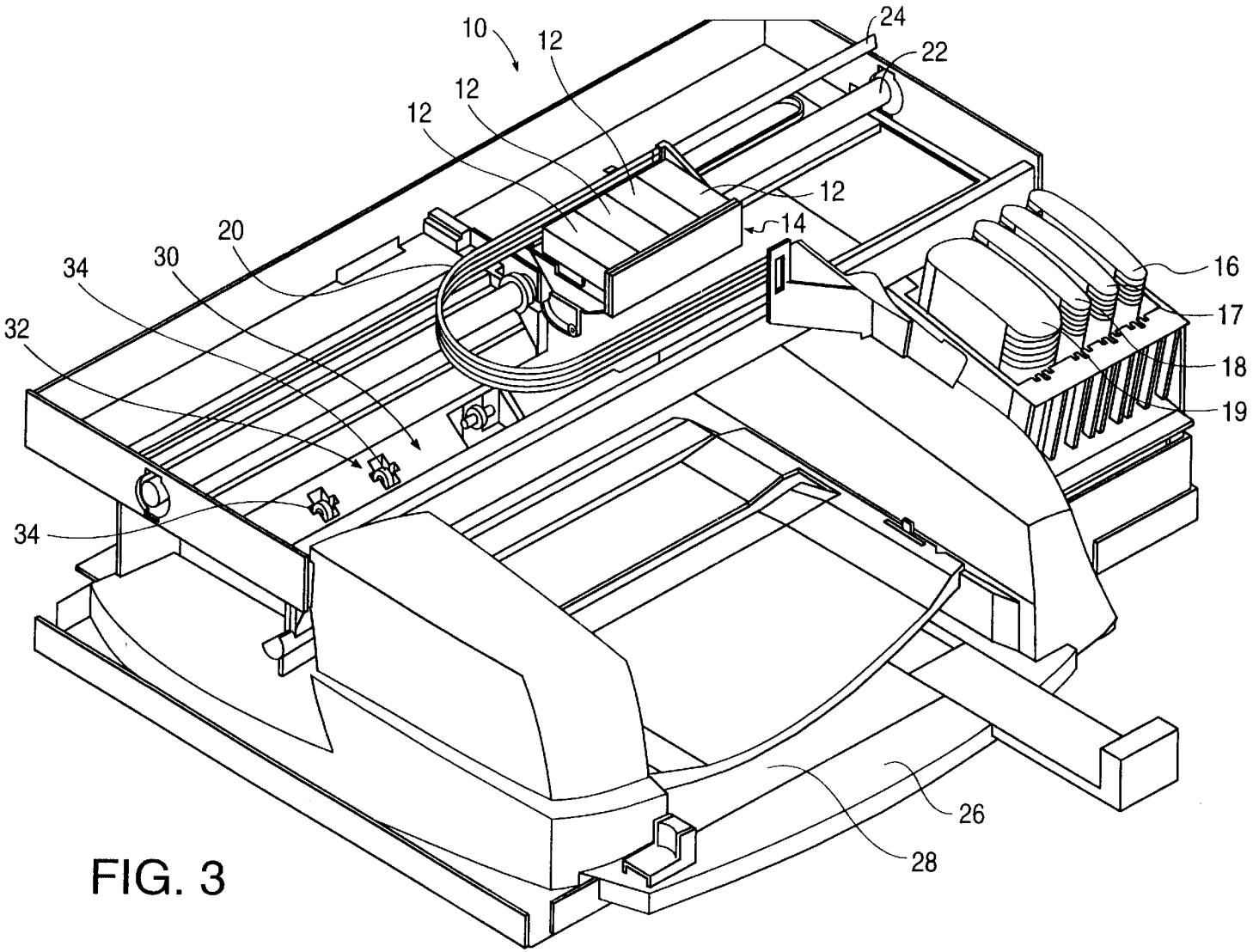
FIG. 3 is a schematic top plan view of one embodiment of a printer incorporating the present invention.

FIG. 3 illustrates one type of printer 10 which incorporates the present invention for reducing dot displacement error and horizontal banding. Printer 10 uses multiple passes of print cartridges 12 over the same area of a medium. The most common type of medium to be printed upon is paper, including standard copy paper and glossy paper. Any inkjet printer may incorporate the present invention, and FIG. 3 simply provides one type of printer.

Print cartridges 12, each including a printhead, are mounted on a scanning carriage 14, which scans from left to right or right to left while energization signals are applied to the printheads to print ink droplets or dots along the medium. Ink supplies 16–19 provide a different color of ink to each print cartridge 12 via tubes 20. Alternatively, each print cartridge 12 contains a substantial reservoir of ink, and ink supplies 16–19 are eliminated.

Scanning carriage 14 slides along a slide rod 22 via a well-known belt and pulley system, and a coded strip 24 is electronically read by an optical detector on scanning carriage 14 to identify the horizontal pixel position of carriage 14.

Figure 4:
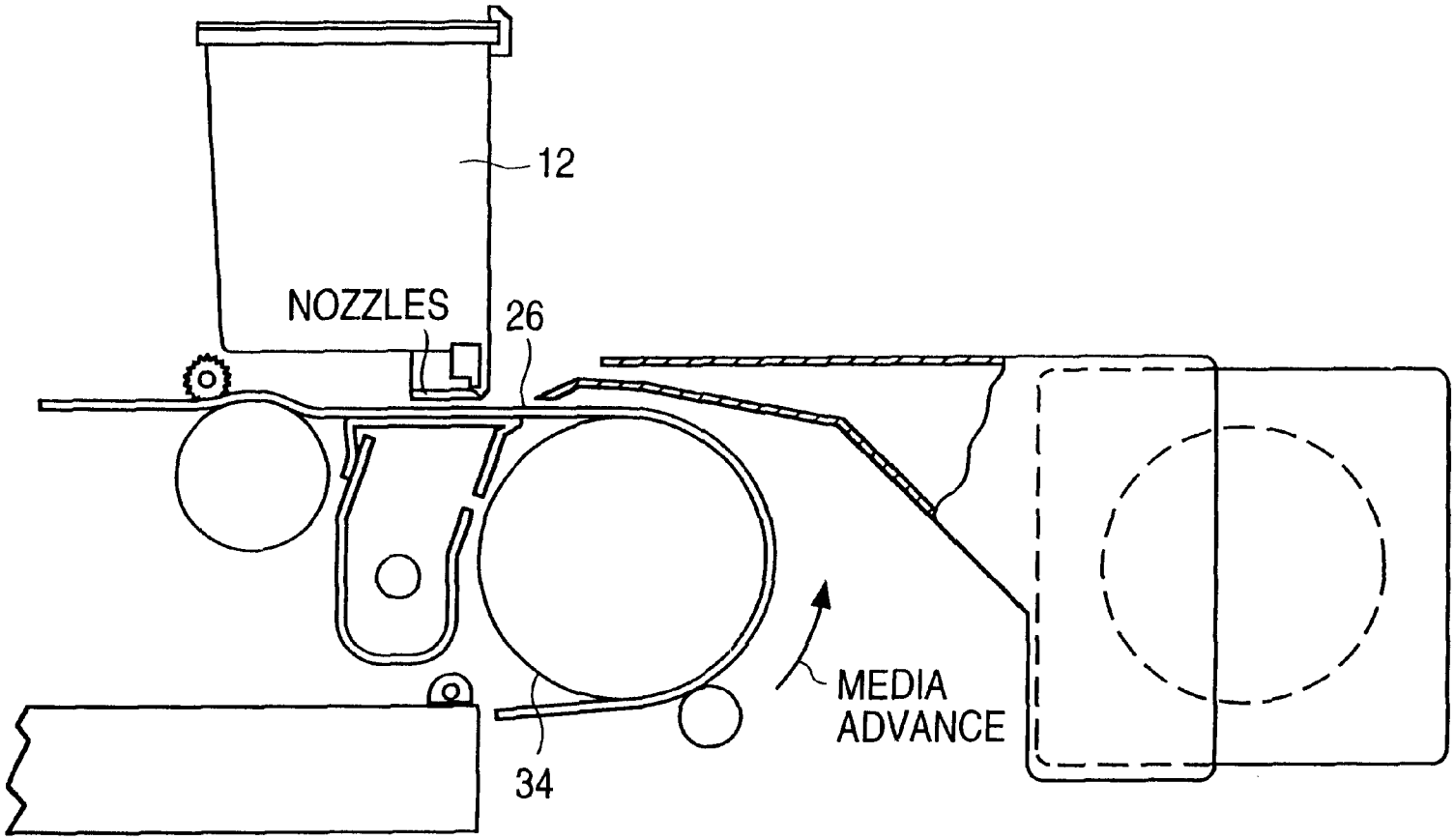
FIG. 4 is a schematic side elevational sectional view illustrating, for one of the print cartridges of the printer of FIG. 3, the relationship between the downwardly facing inkjet nozzles and the print medium.

A supply tray 26 contains sheets of paper 28 which are fed one by one into a print zone 30 of printer 10. The paper 28 is incrementally shifted through print zone 30 in a direction perpendicular to the scanning of carriage 14 by an advance mechanism 32. As illustrated in FIGS. 3 and 4, the advance mechanism 32 includes frictional print rollers 34 and a stepper motor (not shown). The paper path may be straight or may be curved as shown in FIG. 4.

Figure 5:
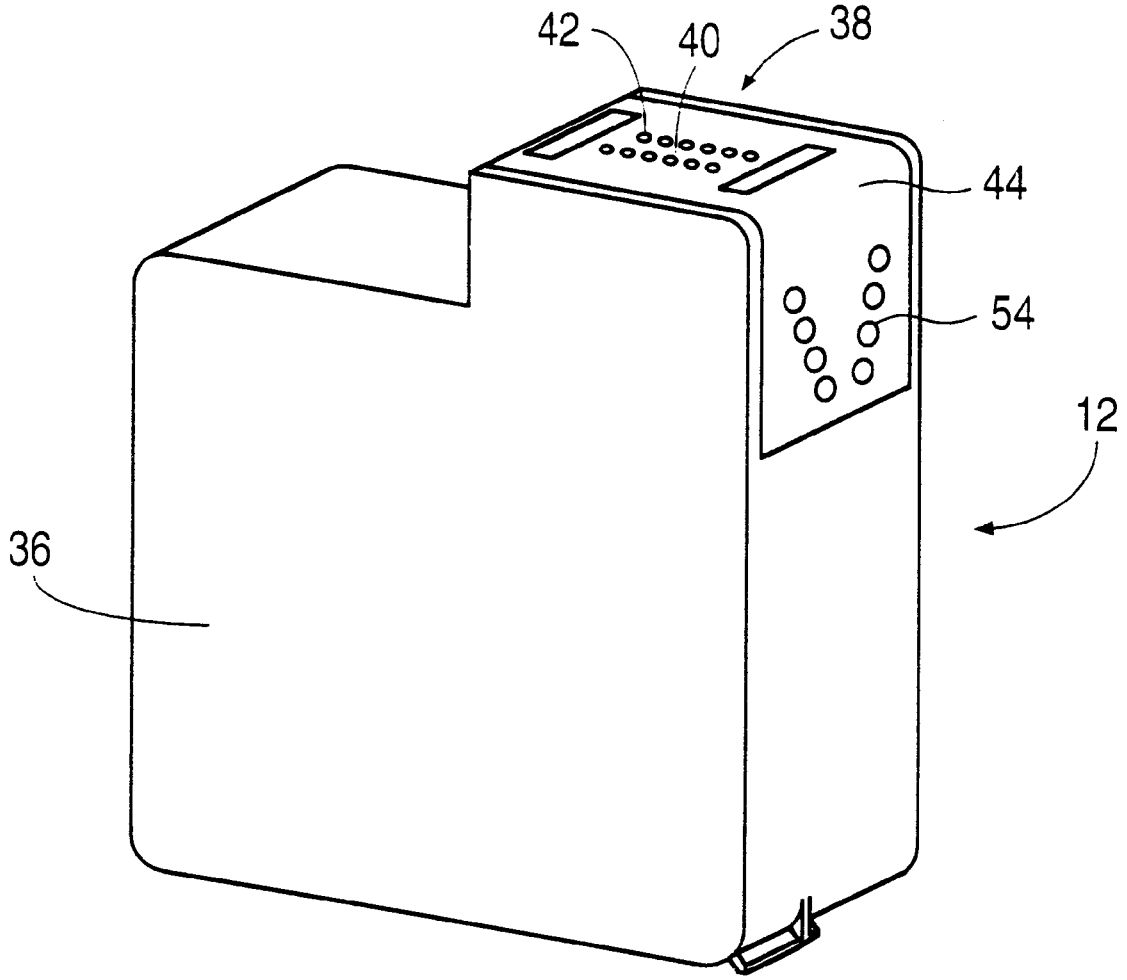
FIG. 5 is a perspective view of a simplified schematic of one type of print cartridge which can be installed on an inkjet printer and controlled to carry out the present invention.

FIG. 5 illustrates a simplified version of one type of print cartridge 12 which may be used in printer 10. Print cartridge 12 may include an ink inlet (not shown) connected to one of the flexible tubes 20 in FIG. 3. Alternatively, print cartridge 12 may be a disposable type containing a single supply of ink. Print cartridge 12 includes an ink reservoir 36 and a printhead 38. Printhead 38 is formed using Tape Automated Bonding. Printhead 38 (hereinafter "TAB head assembly 38") includes a nozzle member 40 comprising two parallel columns of offset orifices or nozzles 42 formed in a flexible polymer circuit 44 by, for example, laser ablation. Further details about print cartridge 12 and the manufacture of TAB head assembly 38 may be found in U.S. Pat. No. 5,638,101, which is assigned to the present assignee and incorporated herein by reference.

Figure 6:
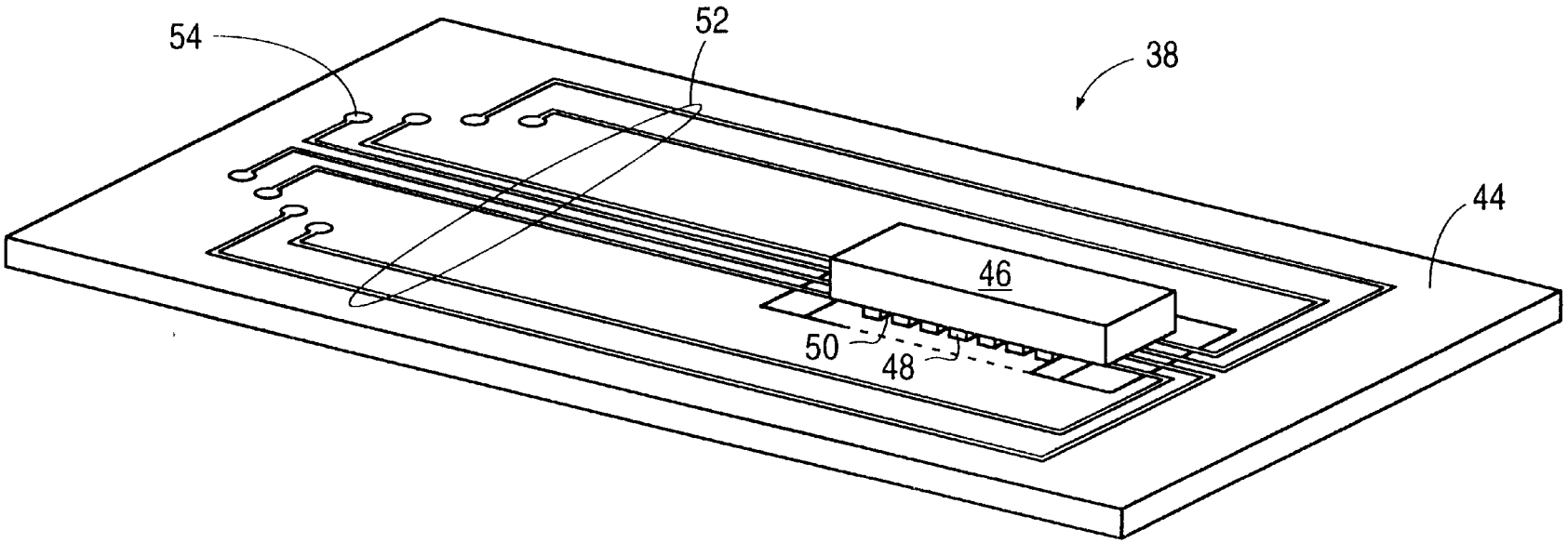
FIG. 6 is a perspective view of the back surface of a Tape Automated Bonding (TAB) printhead assembly (hereinafter "TAB head assembly") removed from the print cartridge of FIG. 5, showing a silicon substrate mounted thereon and the conductive leads attached to the substrate.

FIG. 6 illustrates the back surface of flexible circuit 44. Mounted on the back surface is a silicon substrate 46. Substrate 46 includes a plurality of individually energizable ink ejection elements, such as thin film resistors, each of which is located generally behind a single orifice 42. Substrate 46 includes a barrier layer 48 with ink channels 50 formed therein. Ink channels 50 receive ink from ink reservoir 36. The back surface of flexible circuit 44 includes conductive traces 52 formed thereon by a conventional lithographic etching and/or plating process. These conductive traces 52 terminate in large contact pads 54 on a front surface of flexible circuit 44. Contact pads 54 contact printer electrodes when print cartridge 12 is installed in printer 10 to transfer externally generated energization signals to TAB head assembly 38.

Nozzles 42 and conductive traces 52 may be of any size, number, and pattern, and the various figures are designed to show simply the features of the invention. The relative dimensions of the various features have been greatly adjusted for the sake of clarity.

Figure 7:
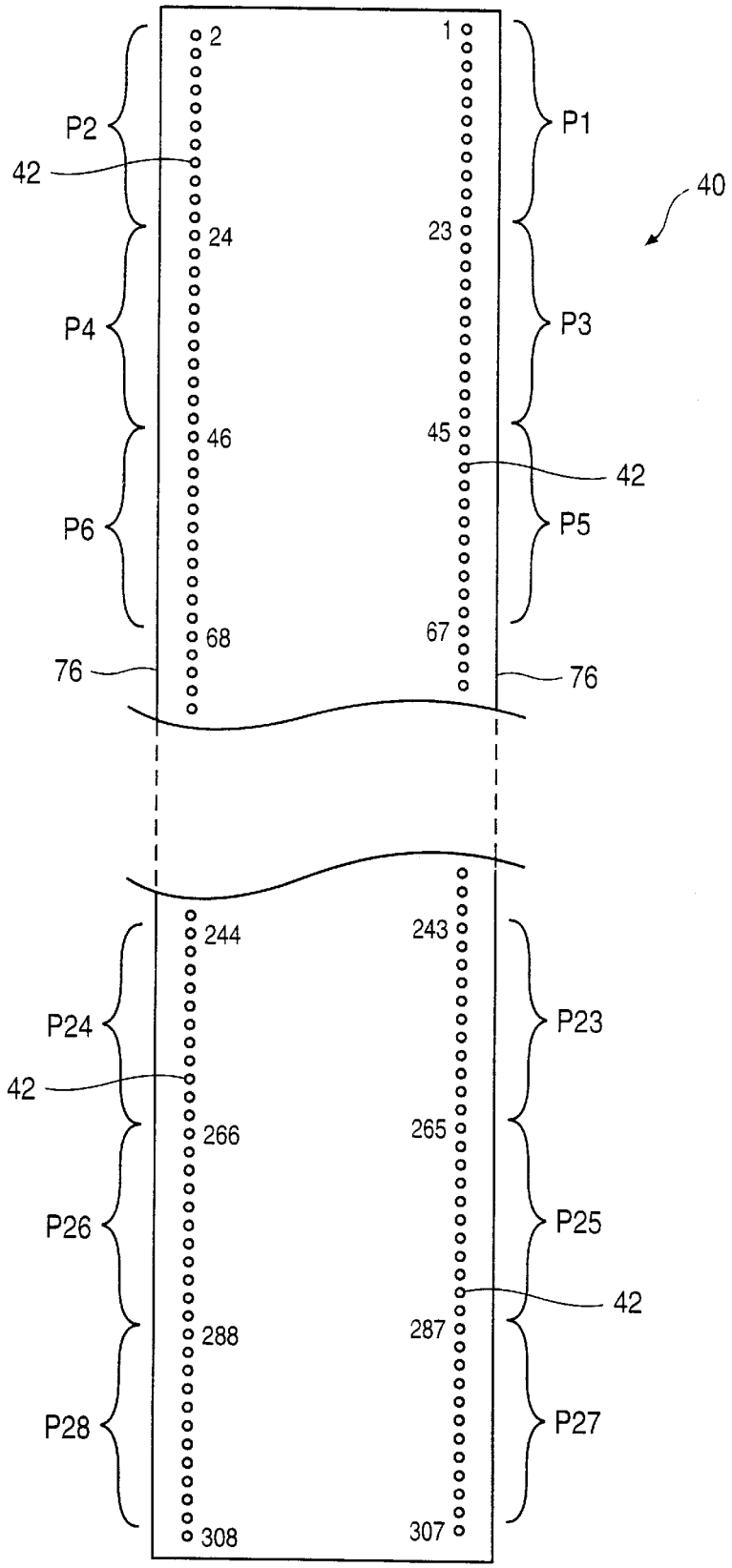
FIG. 7 is a view of one arrangement of nozzles and the associated ink ejection elements on the TAB head assembly.

FIG. 7 provides a detailed illustration of one nozzle member 40 which can be formed on TAB head assembly 38 of print cartridge 12. Nozzles 42 of nozzle member 40 are arranged in two columns. For purposes of clarity, the nozzles are conventionally assigned a number as shown, starting at the top right as TAB head assembly 38 is viewed from the external surface of nozzle member 40 and ending in the lower left, thereby resulting in the odd numbers being arranged in a first column and the even numbers in a second column. The nozzles in each column are spaced approximately 1/300 of an inch apart along the direction nozzle member 40, and the nozzles of one column are offset from the nozzles of the other column by approximately 1/600 of an inch, thus providing 600 dpi printing.

Nozzles 42 and their associated ink ejection elements 62 and vaporization chambers 64 (FIG. 8) are organized into primitives (P1, P2, etc.), with each primitive having a primitive size defined by the number of nozzles or elements in the primitive. Ink ejection elements 62 may be heater resistors or piezoelectric elements. The nozzle member 40 illustrated in FIG. 7 has twenty-eight primitives of eleven nozzles each, for a total of 308 nozzles. It should be noted that the number of primitives and the primitive sizes of nozzle member 40 may be arbitrarily selected.

Figure 8:
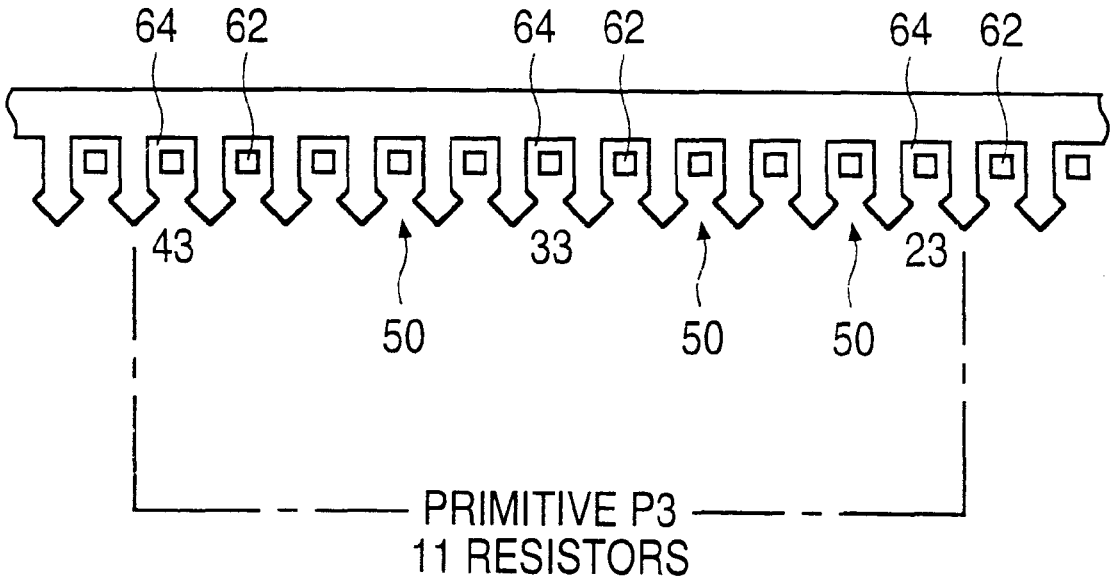
FIG. 8 is a top plan view of one primitive of the TAB head assembly, including ink ejection elements, vaporization chambers, ink channels and barrier architecture.
Figure 9A:
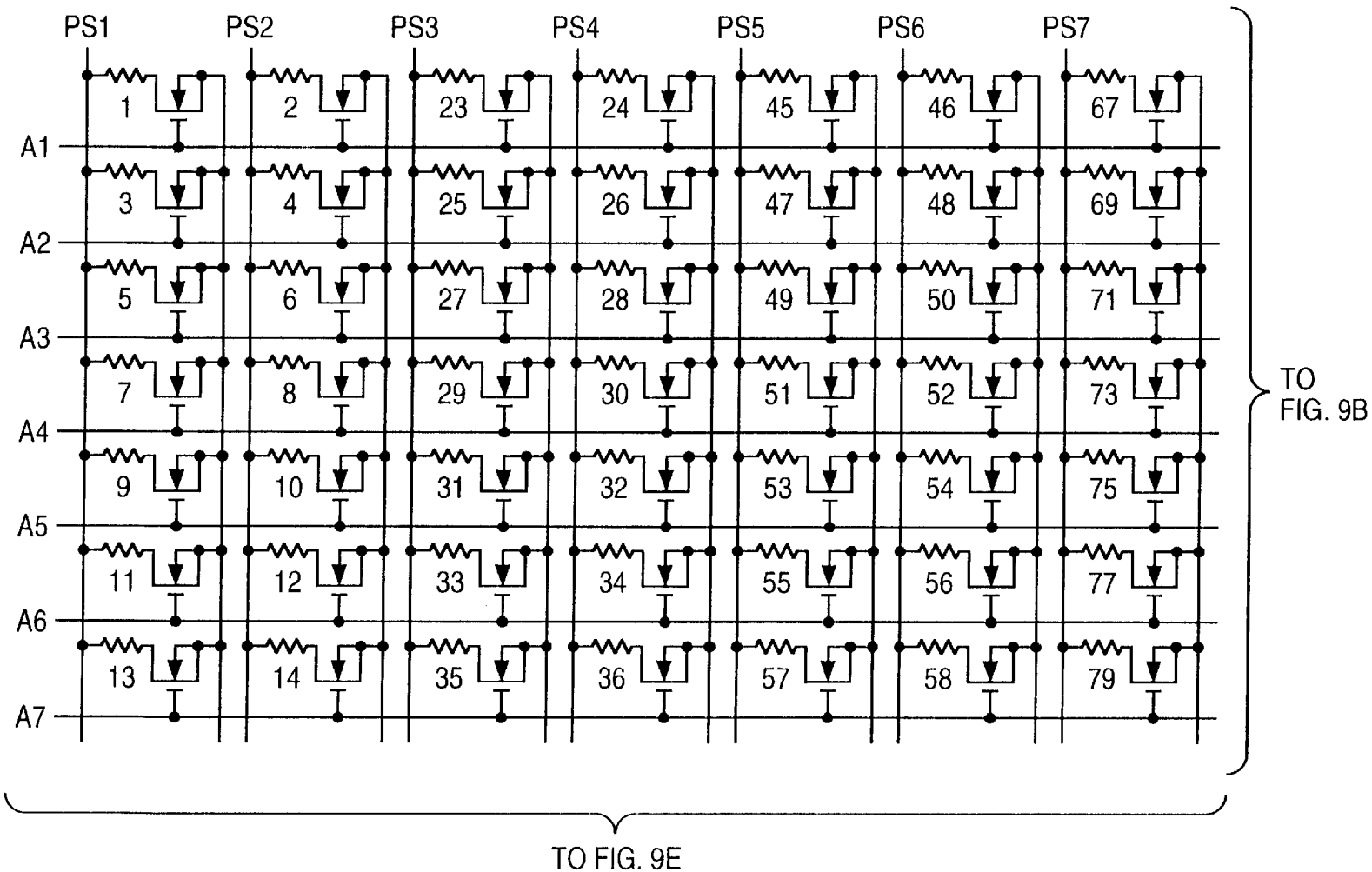
FIGS. 9A–9H form a schematic diagram of the ink ejection elements and the associated Address Select lines, Primitive Select lines and Ground lines which may be employed in the present invention.
Figure 9B:
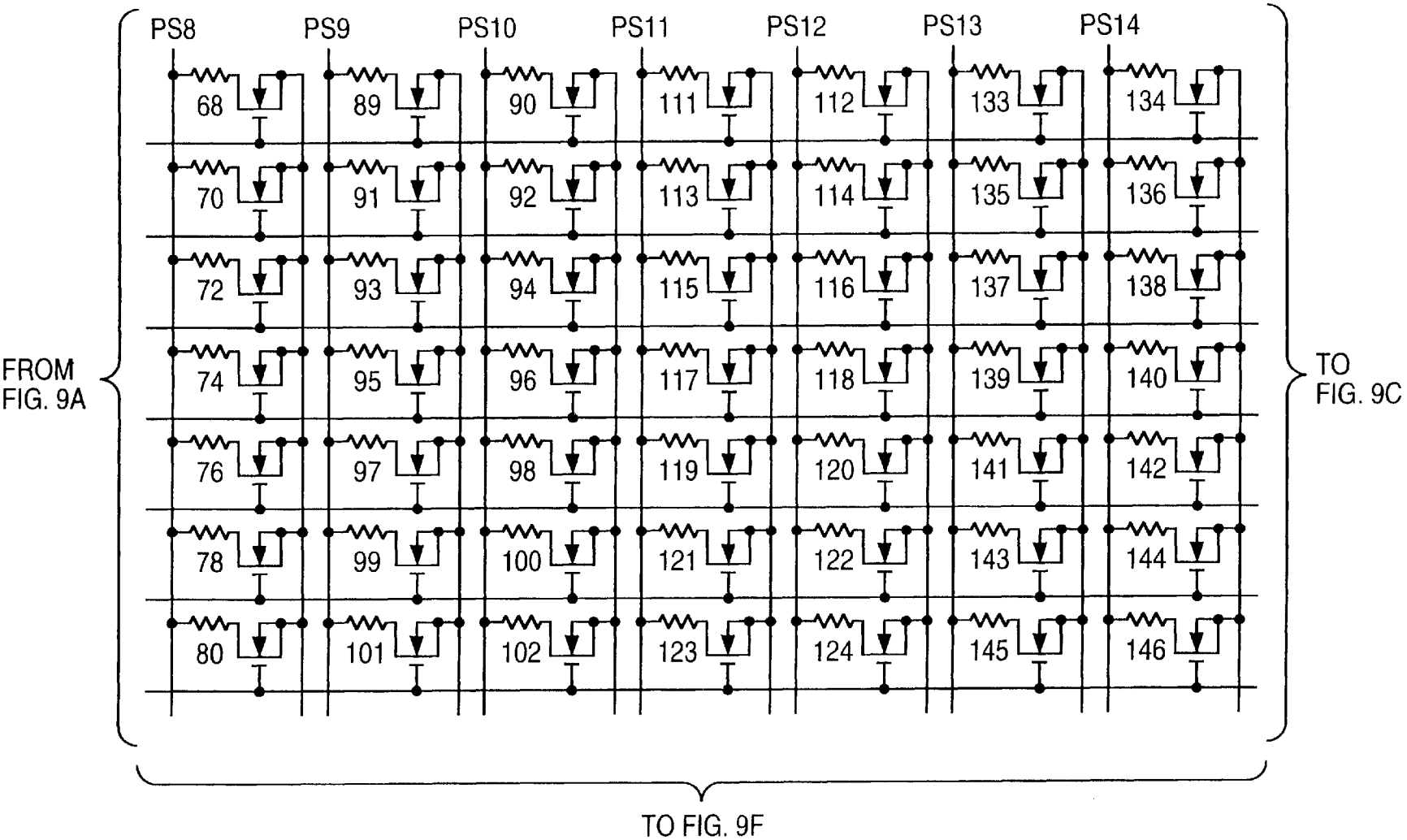
Figure 9C:
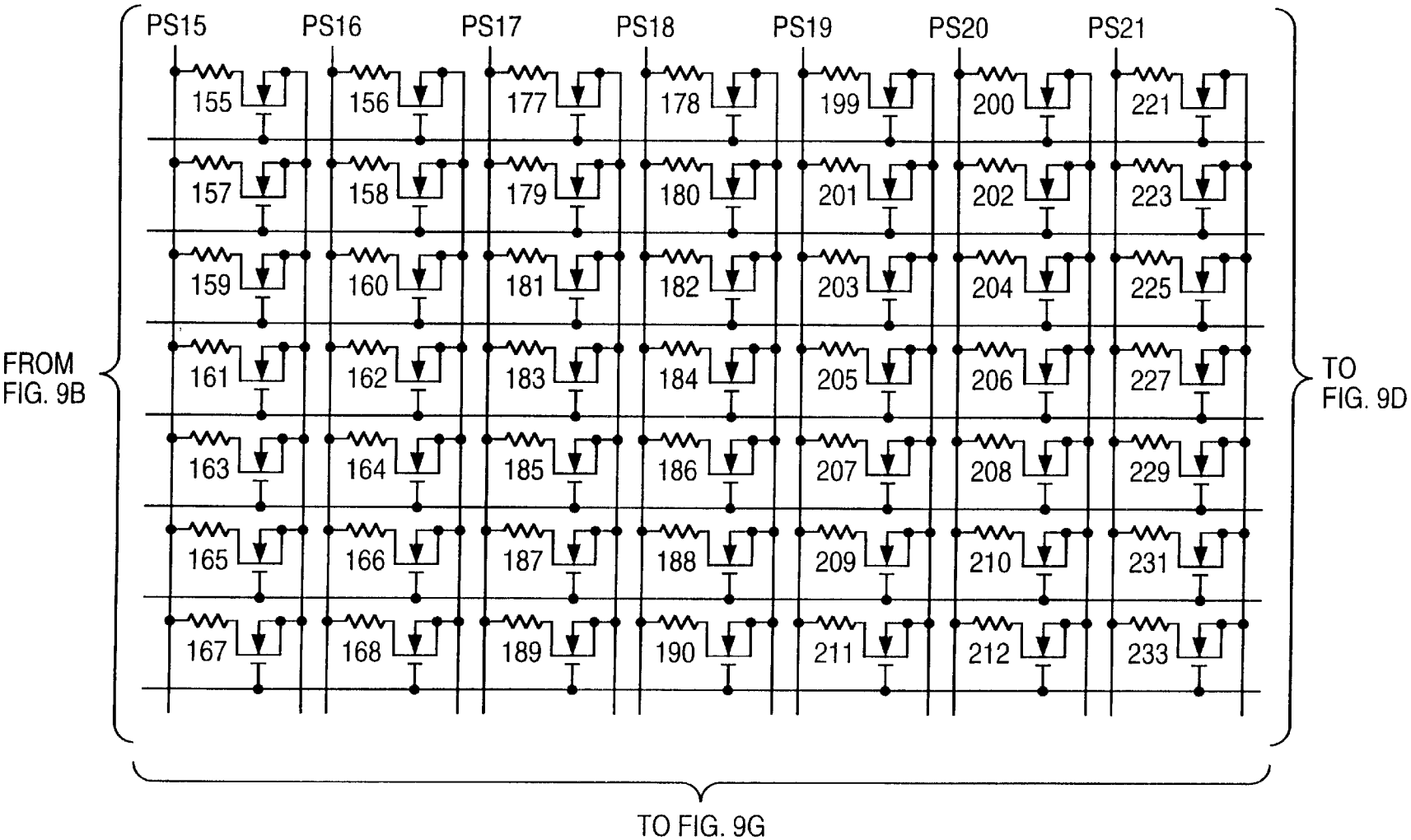
Figure 9D:
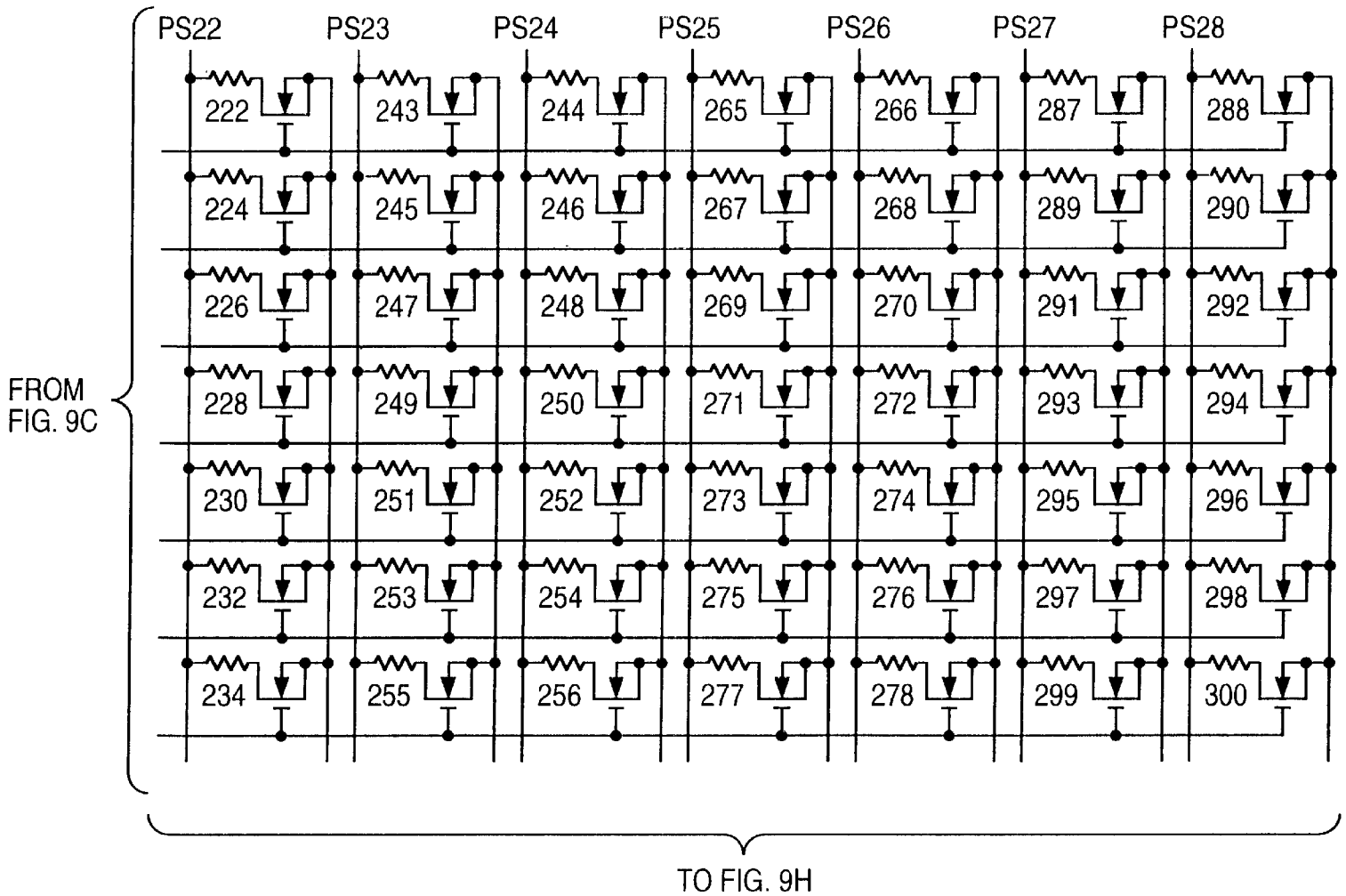
Figure 9E:
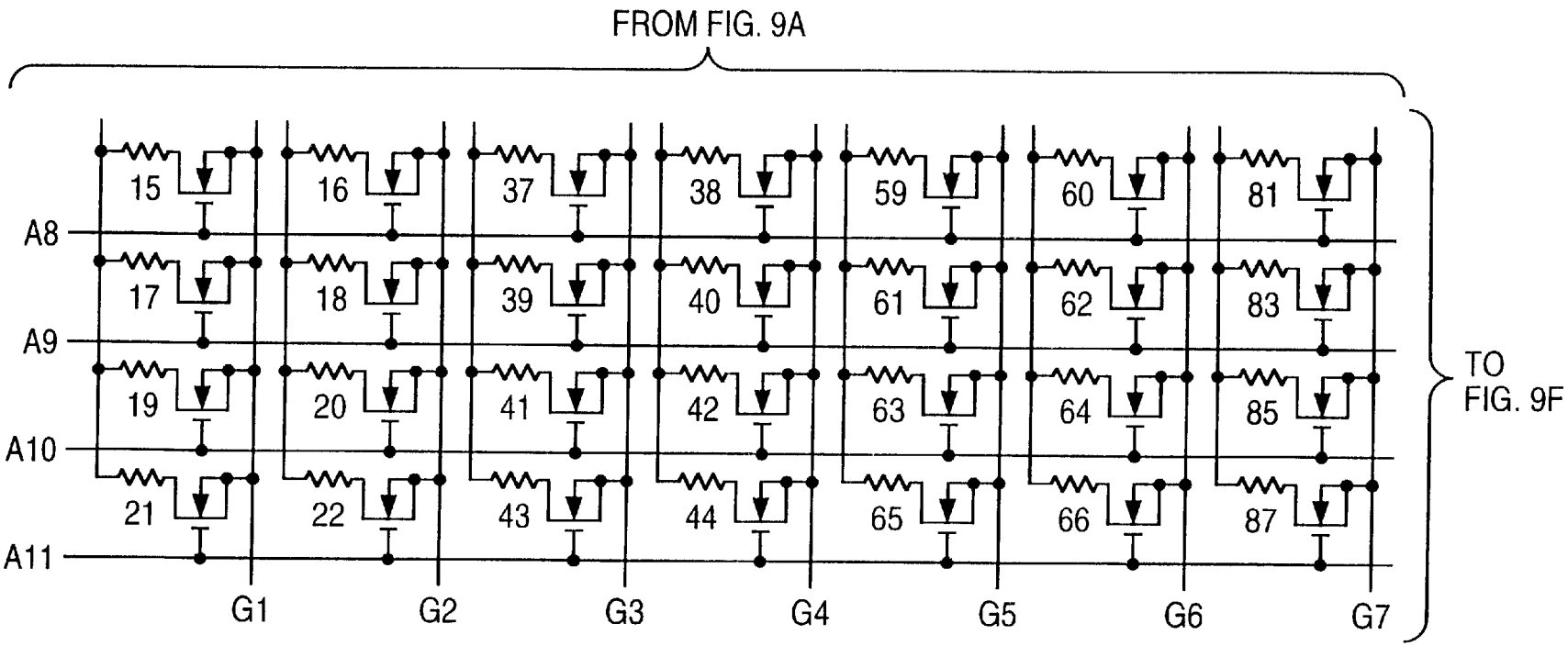
Figure 9F:
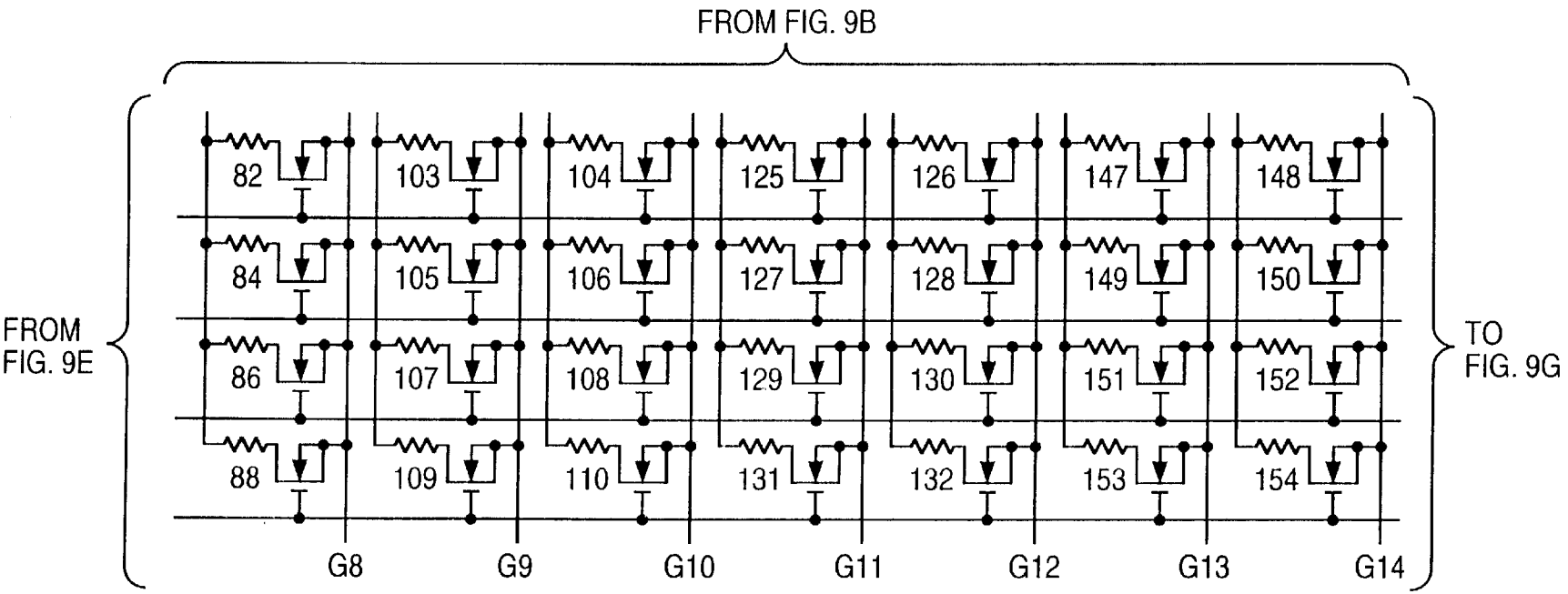
Figure 9G:
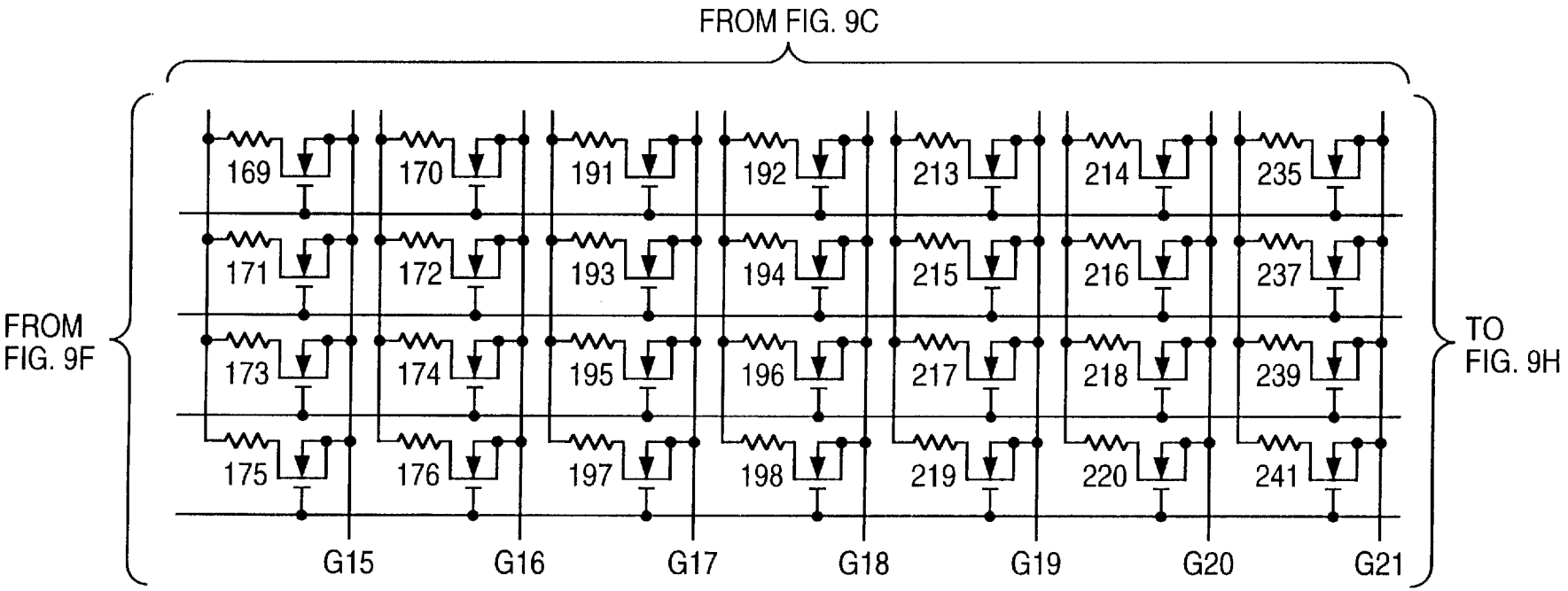
Figure 9H:
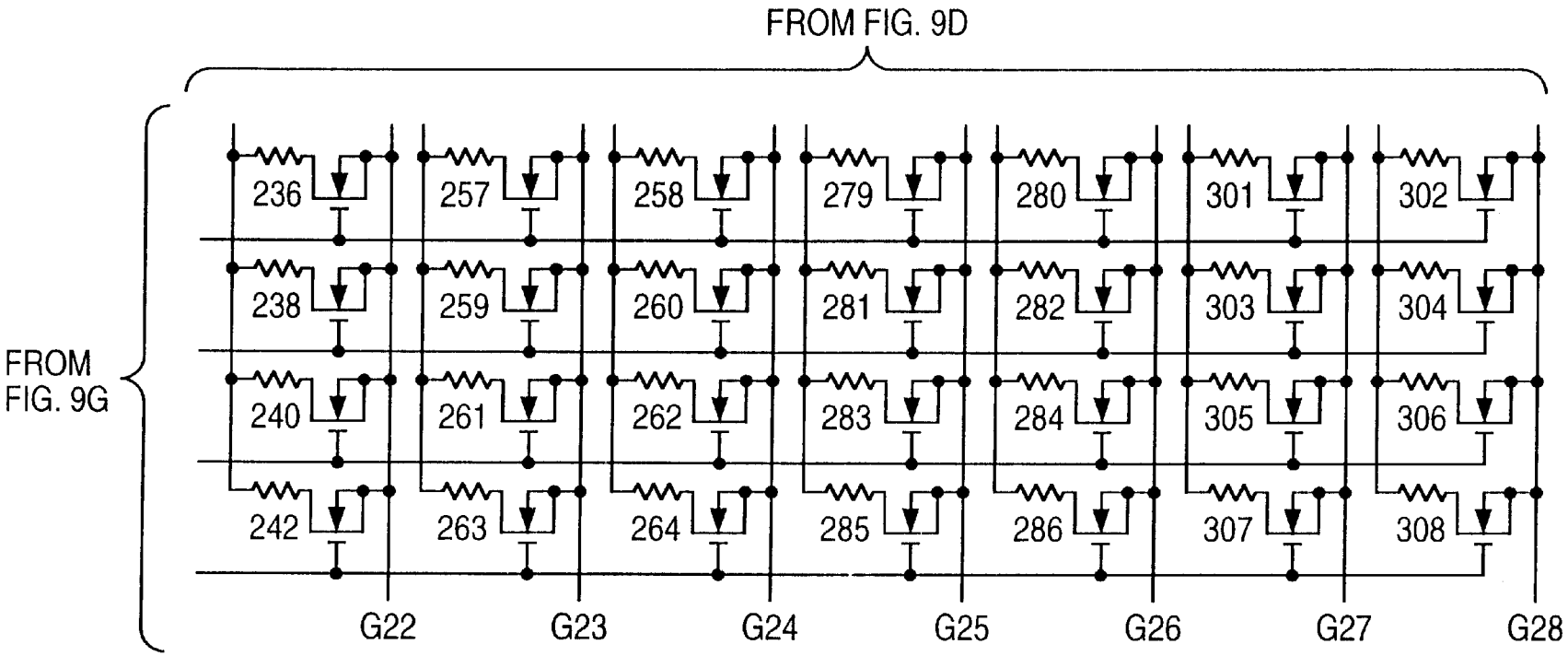

Nozzles 42 are aligned in two vertical columns along nozzle member 40, with the nozzles of a column in complete alignment with other nozzles of the same column. Thus, a distance between a side edge 76 of nozzle member and one nozzle 42 of a column is identical for every nozzle 42 of that column. Arrangement of nozzles 42 in two non-staggered columns is preferable to columns with staggered nozzles. The ink flow distance from side edge 70 of substrate 46 to a vaporization chamber 64 is the same for each vaporization chamber, eliminating any differences in the volume and velocity of ejected ink droplets and the speed at which the vaporization chamber can be refilled. As illustrated in FIG. 8, each nozzle 42 is aligned with a respective ink ejection element 62 and vaporization chamber 64.

Figure 10:
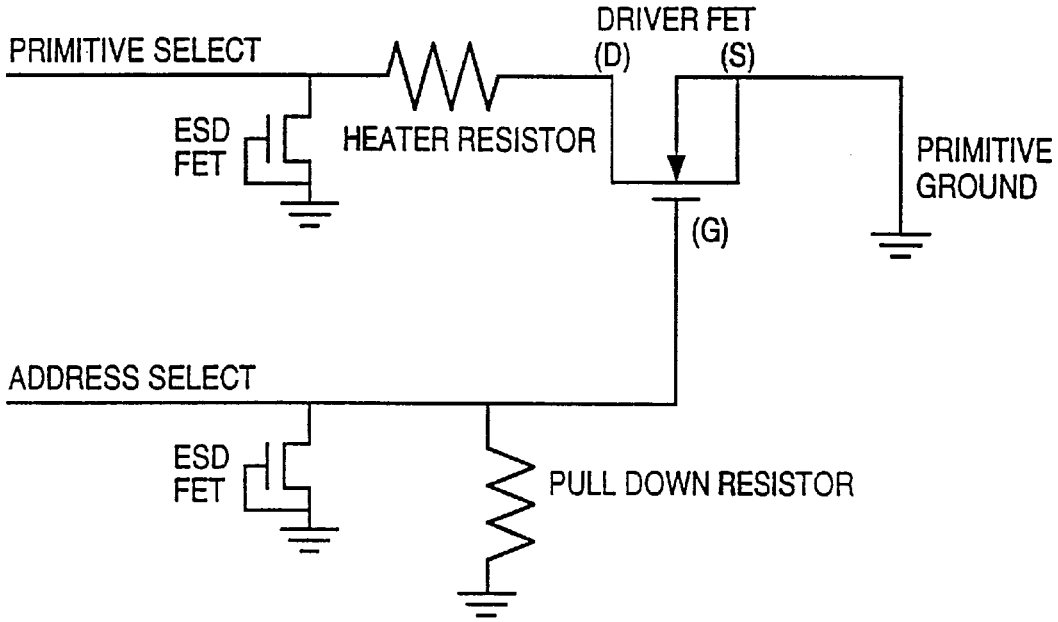
FIG. 10 (Prior Art)
FIG. 10 is a schematic diagram of one ink ejection element FIGS. 9A–9H and its associated Address Select line, drive transistor, Primitive Select and Ground lines.

Ink ejection elements 62 are coupled to electrical circuitry and are organized into groups of twenty-eight primitives of eleven ink ejection elements. Referring now to FIGS. 9A–9H, each ink ejection element (numbered 1 through 308) is controlled by its own FET drive transistor, which shares its control input Address Select (A1–11) with twenty-seven other elements. Each ink ejection element is coupled to ten other elements by a common node Primitive Select (PS1–PS28). FIG. 10 is a schematic diagram of an individual ink ejection element and its FET drive transistor. As illustrated in FIG. 10, the Address Select and Primitive Select lines also contain transistors for draining unwanted electrostatic discharge and pull down resistors to place all unselected addresses in an off state.

FIGS. 9A–9H and 11A–11C illustrate the correlation between nozzles/ink ejection elements 1–308 and their Address Select and Primitive Select lines. Nozzles and associated ink ejection elements at the same position on their respective primitives have the same Address Select line. For example, ink ejection elements 1, 2, 23, 24, 45 and 46, which are located at the first position of their primitives P1–P6, respectively, are associated with Address Select line A1.

Figure 12:
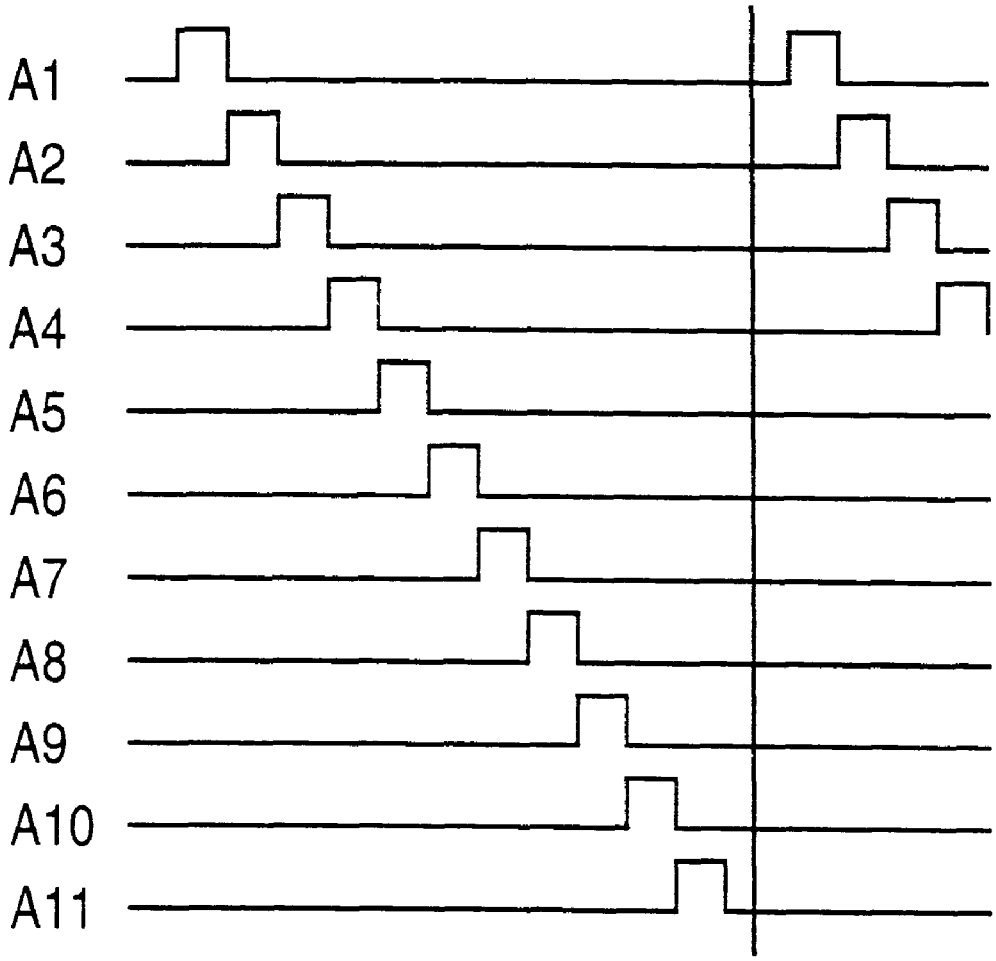
FIG. 12 is a schematic diagram of the firing sequence for the Address Select lines when the scanning carriage moves from left to right.

Firing a particular ink ejection element requires applying a control voltage at its "Address Select" terminal and an electrical power source at its "Primitive Select" terminal. Only one Address Select line is enabled at a time to ensure that the Primitive Select and Group Return lines supply current to at most one ink ejection element at a time. Otherwise, the energy delivered to an ink ejection element would be a function of the number of elements 62 being fired at the same time. The Address Select lines are sequentially turned on via TAB head assembly interface circuitry according to a fire order counter located on printhead 38 and sequenced (independently of the data directing which ink ejection element is to be energized) from A1 to A11 when printing from left to right and from A11 to A1 when printing from right to left. In the alternative, the fire order counter may be located in printer 10. FIG. 12 illustrates the fire order when the scanning carriage scans from left to right. The print data retrieved from the printhead 38 turns on any combination of Primitive Select lines, which control the pulse width.

Print cartridge 12 cycles through its fire order multiple times per pixel. In the preferred embodiment, print cartridge 12 proceeds through its fire order four times per pixel, thereby reducing any dot displacement error to one-fourth of the error if the print cartridge cycled through its fire order only once per pixel.

In response to print commands from printhead 38, each primitive is selectively fired by powering the associated primitive select interconnection. Only one element per primitive is energized at a time, however, any number of primitive selects may be enabled concurrently. Each enabled primitive select thus delivers both power and one of the enable signals to the driver transistor. The other enable signal is an address signal provided by each address select line, only one of which is active at a time. Each address select line is tied to all of the switching transistors so that all such switching devices are conductive when the interconnection is enabled. Where a primitive select interconnection and an address select line for an element 62 are both active simultaneously , that particular element is energized.

Referring back to FIGS. 3 and 4, advance mechanism 32 advances paper 26 through printer 10 during a print operation. In the present invention, advance mechanism 32 advances paper 26 by a distance or number of rows equal to an even multiple of the primitive size, so that a row of ink printed, which is printed in a multiple pass operation, will contain evenly spaced ink dots. Thus, for print cartridge 12 with nozzle member 40 as illustrated in FIG. 7, advance mechanism 32 advances paper 26 by twenty-two, forty-four, sixty-six, etc. (i.e., any even multiple of eleven) rows. Coordination of the medium advance with the primitive size enables each row of ink to be generated by ink ejection elements of the same address line. Thus, the characteristic dot displacement error, which is associated with a particular Address Select line, remains constant for that row, and all ink dots along the row are evenly spaced apart, thereby reducing visible horizontal bands.

Thus, a printer in accordance with the present invention operates as follows. Scanning carriage 14 with print cartridge 12 mounted thereon moves along slide rod 22 in a first direction, such as from left to right. As scanning carriage 14 moves toward the right, energization signals are applied to print cartridge 12 and nozzles 42 deposit a first portion of ink onto paper 26. Once scanning carriage 14 reaches the right side slide rod 22, advance mechanism 32 shifts paper 26 through print zone 30 by a number of rows equal to an even multiple of the primitive size of print cartridge 12. Scanning carriage 14 then moves along slide rod in the opposite direction, from right to left, and print cartridge 12 deposits a second portion of ink on paper 26. This process is repeated until the entire portion of ink has been deposited on paper 26. Print cartridge 12 reduces dot displacement error by cycling through its fire order multiple times per pixel. In addition, coordination of advance mechanism 32 with the primitive size of print cartridge 12 ensures that only ink ejection elements of a particular Address Select line generate ink drops for a particular row, thereby reducing horizontal banding.

While particular embodiments of the present invention have been shown and described, it will be obvious to those skilled in the art that changes and modifications may be made without departing from this invention in its broader aspects, and, therefore, the appended claims are to encompass within their scope all such changes and modifications as fall within the true spirit and scope of this invention.

What is claimed is:

1. A printer for printing rows of ink dots onto a medium, the printer comprising:

a scanning carriage for scanning across the medium;

a printhead mounted on the scanning carriage, the printhead including a plurality of primitives, each primitive having a plurality of non-staggered nozzles for ejecting ink therefrom and a plurality of ink ejection elements, each ink ejection element associated with a respective nozzle of the respective primitive, each primitive having a primitive size defined by the plurality of nozzles of the primitive;

an address select circuit electrically coupled to the ink ejection elements of different primitives and including a plurality of address lines, wherein ink ejection elements of different primitives located at a same position on the ink ejection elements' respective primitives have the same address line; and an advance mechanism for advancing the medium through the printer, wherein the advance mechanism advances the medium by a distance equal to an integer multiple of the primitive size so that ink dots within a row are generated by ink ejection elements associated with the same address line.

2. The printer of claim 1 wherein the printhead cycles through a fire order multiple times per pixel.

3. The printer of claim 2 wherein the printhead cycles through its fire order is four times per pixel.

4. The printer of claim 1 wherein the advance mechanism advances the medium by a distance equal to twice the primitive size.

5. The printer of claim 1 wherein the plurality of nozzles is eleven.

6. The printer of claim 5 wherein the advance mechanism advances the medium by twenty-two rows.

7. The printer of claim 1 wherein the advance mechanism includes at least one print roller.

8. A method of printing rows of ink dots onto a medium, the method comprising:

scanning a printhead across the medium to print a first portion of the rows of ink dots, the printhead including a plurality of primitives, each primitive having a plurality of non-staggered nozzles for ejecting ink therefrom and a plurality of ink ejection elements, each ink ejection element associated with a respective nozzle of the respective primitive, ink ejection elements of different primitives located at a same position on the ink ejection elements' respective primitives having a same address line, each primitive having a primitive size defined by the plurality of nozzles;

advancing the medium by a distance equal to an integer multiple of the primitive size of the printhead; and scanning the printhead across the medium to print a second portion of the rows of ink dots, wherein advancing the medium by a distance equal to the integer multiple of the primitive size enables ink dots within a row to be printed by ink ejection elements associated with the same address line, thereby reducing horizontal banding.

9. The method of claim 8 wherein the nozzles of the printhead are aligned in at least two, non-staggered columns along the length of the printhead.

10. The method of claim 8 wherein the printhead includes an address select circuit electrically coupled to the ink ejection elements, the address select circuit having a plurality of address lines, and wherein ink ejection elements of different primitives located at a same position on the ink ejection elements' respective primitives have the same address line.

11. The method of claim 8 further comprising cycling the printhead through a fire order multiple times per pixel.

12. The method of claim 11 wherein the printhead cycles through the printhead's fire order four times per pixel.

13. The method of claim 8 wherein advancing the medium includes advancing the medium by a distance equal to twice the primitive size.

14. The method of claim 8 wherein the plurality of nozzles is eleven.

15. The method of claim 14 wherein the medium is advanced by twenty-two rows.

16. The method of claim 8 wherein advancing the medium includes rotating at least one print roller.

17. A method of printing rows of ink dots onto a medium, the method comprising:

scanning a printhead across the medium to print a first portion of the rows of ink dots, the printhead cycling through a fire order at least twice per pixel and including:

a plurality of primitives, each primitive having a plurality of non-staggered nozzles for ejecting ink therefrom, a plurality of ink ejection elements, each ink ejection element associated with a respective nozzle of the respective primitive, each primitive having a primitive size defined by the plurality of ink ejection elements; and an address select circuit electrically coupled to the ink ejection elements of the printhead, the address select circuit including a plurality of address lines, wherein ink ejection elements of different primitives located at a same position on the ink ejection elements' respective primitives have a same address line;

advancing the medium by a distance equal to an integer multiple of the primitive size of the printhead; and scanning the printhead across the medium to print a second portion of the rows of ink dots, wherein the first and second portions of each row of ink dots are produced by ink ejection elements associated with the same address line.

18. The method of claim 17 wherein the printhead cycles through the printhead' fire order four times per pixel.

19. The method of claim 17 wherein advancing the medium includes advancing the medium by a distance equal to twice the primitive size.

20. The method of claim 17 wherein the plurality of ink ejection elements is eleven.

21. The method of claim 20 wherein the medium is advanced by twenty-two rows.

22. The method of claim 17 wherein advancing the medium includes rotating at least one print roller.

23. The method of claim 17 further comprising scanning the printhead across the medium to print a third portion of the rows of ink dots, wherein the first, second and third portions of each row of ink dots are produced by ink ejection elements of the same address line.

* * * * *

UNITED STATES PATENT AND TRADEMARK OFFICE

CERTIFICATE OF CORRECTION

PATENT NO. : 6,217,147 B1
DATED : April 17, 2001
INVENTOR(S) : Clayton L. Holstun It is certified that error appears in the above-identified patent and that said Letters Patent is hereby corrected as shown below:

Column 7,
Line 60, after "through" insert -- the printhead´s --

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*